US011162510B2

(12) United States Patent
Watanabe

(10) Patent No.: US 11,162,510 B2
(45) Date of Patent: Nov. 2, 2021

(54) POWER SOURCE-INTEGRATED VACUUM PUMP

(71) Applicant: SHIMADZU CORPORATION, Kyoto (JP)

(72) Inventor: Kota Watanabe, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 211 days.

(21) Appl. No.: 15/879,267

(22) Filed: Jan. 24, 2018

(65) Prior Publication Data

US 2018/0245603 A1 Aug. 30, 2018

(30) Foreign Application Priority Data

Feb. 27, 2017 (JP) ..... JP2017-034824

(51) Int. Cl.
*F04D 29/58* (2006.01)
*F04D 25/06* (2006.01)
(Continued)

(52) U.S. Cl.
CPC ..... *F04D 29/5806* (2013.01); *F04D 19/042* (2013.01); *F04D 25/0606* (2013.01);
(Continued)

(58) Field of Classification Search
CPC .. F04D 29/58; F04D 29/5806; F04D 29/5813; F04D 29/582; F04D 19/04;
(Continued)

(56) References Cited

U.S. PATENT DOCUMENTS 5,378,128 A * 1/1995 Yanagisawa ..... F04C 29/005 418/9
5,971,725 A * 10/1999 de Simon ..... F04D 19/04 417/423.1
(Continued)

FOREIGN PATENT DOCUMENTS

CN 103089668 5/2013
DE 102016100642 A1 * 4/2016 ..... F01C 19/005
(Continued)

OTHER PUBLICATIONS

Reasons for Refusal for corresponding Japanese Patent Application No. 2017-034824, dated Feb. 26, 2020.
(Continued)

*Primary Examiner* — Philip E Stimpert
(74) *Attorney, Agent, or Firm* — Renner, Otto, Boisselle & Sklar, LLP

(57) ABSTRACT

A power source-integrated vacuum pump in which a pump main body including a pump rotor and a pump power source configured to supply power to the pump main body are integrated together, comprises: a pump housing configured to house the pump rotor; a power source housing of the pump power source, the power source housing being fixed to the pump housing; a heat transfer member provided at a fixing portion between the pump housing and the power source housing in contact with the pump housing and the power source housing; and a sealing member provided at the fixing portion between the pump housing and the power source housing to seal between the pump housing and the power source housing.

6 Claims, 8 Drawing Sheets

(51) Int. Cl.

| | |
|---|---|
| ***F04D 29/08*** | (2006.01) |
| ***F04D 19/04*** | (2006.01) |
| ***F04D 29/60*** | (2006.01) |
| ***F04D 29/52*** | (2006.01) |

(52) U.S. Cl.
CPC ..... *F04D 25/0693* (2013.01); *F04D 29/083* (2013.01); *F04D 29/584* (2013.01); *F04D 29/5853* (2013.01); *F04D 29/601* (2013.01); *F04D 29/522* (2013.01)

(58) Field of Classification Search
CPC ..... F04D 19/042; F04D 25/0606; F04D 29/0693; F04D 29/584; F04D 29/5853; F04D 29/522; F04D 25/068; F04D 19/0693; F04D 29/08; F04D 29/083; F16J 15/02; F16J 15/021; F16J 15/08; F16J 15/10
See application file for complete search history.

(56) References Cited

U.S. PATENT DOCUMENTS

| | | | | |
|---|---|---|---|---|
| 8,628,309 | B2 | 1/2014 | Nagano et al. | |
| 9,267,392 | B2 | 2/2016 | Schroder et al. | |
| 2006/0078444 | A1* | 4/2006 | Sacher | F04B 49/065 417/423.3 |
| 2012/0321442 | A1* | 12/2012 | Nagano | F04D 19/042 415/116 |
| 2013/0189089 | A1* | 7/2013 | Schroder | F04D 19/042 415/182.1 |
| 2014/0116661 | A1* | 5/2014 | Xu | G06F 1/20 165/133 |
| 2015/0108723 | A1* | 4/2015 | Bekkevold | F16J 15/08 277/609 |
| 2015/0184665 | A1 | 7/2015 | Yamato et al. | |

FOREIGN PATENT DOCUMENTS

| | | | |
|---|---|---|---|
| GN | 102782331 | A | 11/2012 |
| GN | 103228923 | A | 7/2013 |
| JP | 2010-236468 | A | 10/2010 |
| JP | 2010-236469 | A | 10/2010 |
| JP | 2013-100760 | | 5/2013 |
| JP | 2014-43827 | A | 3/2014 |
| JP | 2014105695 | A | 6/2014 |
| WO | 2012/053270 | A1 | 2/2014 |

OTHER PUBLICATIONS

Notice of Reasons for Refusal for corresponding Japanese Patent Application No. 2017-034824, dated Jun. 19, 2020, with English translation.
Office Action for corresponding Japanese Patent Application No. 2017-034824, dated Sep. 7, 2020, with English translation.

* cited by examiner

POWER SOURCE-INTEGRATED VACUUM PUMP

TECHNICAL FIELD

The present invention relates to a power source-integrated vacuum pump.

BACKGROUND ART

A turbo-molecular pump configured to exhaust gas in such a manner that a rotor provided with rotor blades is rotatably driven by a motor and the rotor blades are rotated relative to stationary blades at high speed has been known as a vacuum pump used for a semiconductor manufacturing device etc. A turbo-molecular pump configured such that a pump main body and a control device integrated together are cooled by a cooling fan has been known as the above-described turbo-molecular pump (see, e.g., Patent Literature 1 (JP-A-2013-100760)).

The turbo-molecular pump described in Patent Literature 1 is configured such that a clearance is formed between a base of the pump main body and a housing of the control device and that the control device is cooled by cooling air sent to the clearance.

However, not only a power source cable but also cables for a temperature sensor and a brake resistor provided on a pump main body side are, between the pump main body and the control device, connected to the control device. Thus, the multiple cables are interposed between the pump main body and the control device, and openings for insertion of the multiple cables need to be formed at the housing of the control device. As a result, it is difficult to prevent external moisture air from entering the housing of the control device, and damage of the control device due to moisture air entrance might be caused.

SUMMARY OF THE INVENTION

A power source-integrated vacuum pump in which a pump main body including a pump rotor and a pump power source configured to supply power to the pump main body are integrated together, comprises: a pump housing configured to house the pump rotor; a power source housing of the pump power source, the power source housing being fixed to the pump housing; a heat transfer member provided at a fixing portion between the pump housing and the power source housing in contact with the pump housing and the power source housing; and a sealing member provided at the fixing portion between the pump housing and the power source housing to seal between the pump housing and the power source housing.

The power source-integrated vacuum pump further comprises: a cooling fan configured to send cooling air to the pump housing.

A heat sink is provided in a region of the pump housing to which the cooling air is sent.

The power source housing has a housing wall portion fixed to at least some of multiple electric components provided at the pump power source and contacting the heat transfer member.

The housing wall portion includes a refrigerant path for circulating liquid refrigerant.

A coefficient of thermal conductivity of the heat transfer member is equal to or higher than those of the pump housing and the power source housing.

The heat transfer member also serves as the sealing member.

According to the present invention, radiation performance of a power source can be ensured while external air entrance into the power source can be prevented.

DETAILED DESCRIPTION OF THE EXEMPLARY EMBODIMENTS

Figure 1:
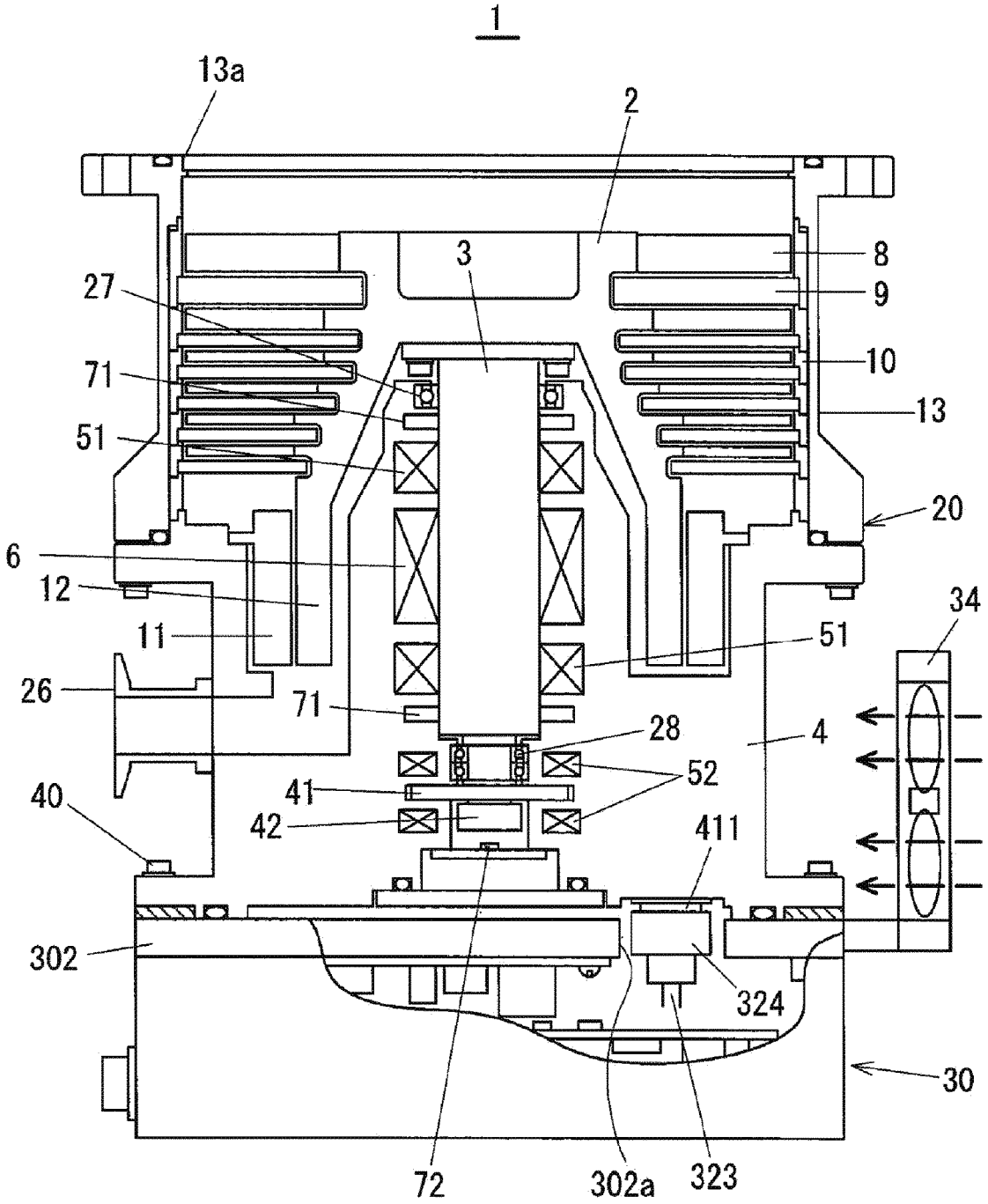
FIG. 1 is a view of a schematic configuration of a power source-integrated vacuum pump of an embodiment.

Hereinafter, an embodiment of the present invention will be described with reference to the drawings. FIG. 1 is a view of a schematic configuration of a power source-integrated vacuum pump of the present embodiment. The vacuum pump 1 is a magnetic bearing turbo-molecular pump, and is configured such that a pump unit 20 and a power source 30 are fixed with bolts 40 as illustrated in FIG. 1.

In the pump unit 20, a shaft 3 attached to a rotor 2 is non-contact supported by electromagnets 51, 52 provided at a pump base 4. The levitation position of the shaft 3 is detected by a radial displacement sensor 71 and an axial displacement sensor 72 provided at the pump base 4. The electromagnets 51 forming radial magnetic bearings, the electromagnets 52 forming axial magnetic bearings, and the displacement sensors 71, 72 form a five-axis control magnetic bearing. Note that when the magnetic bearings are not in operation, the shaft 3 is supported by mechanical bearings 27, 28.

A circular rotor disc 41 is provided at a lower end of the shaft 3, and the electromagnets 52 are provided to sandwich the rotor disc 41 in an upper-to-lower direction through a clearance. The electromagnets 52 attract the rotor disc 41, thereby levitating the shaft 3 in an axial direction. The rotor disc 41 is fixed to a lower end portion of the shaft 3 with a nut member 42.

The rotor 2 is provided with a plurality of rotor blades 8 in a rotation axial direction. Each stationary blade 9 is arranged between adjacent ones of the rotor blades 8 arranged in the upper-to-lower direction. The rotor blades 8 and the stationary blades 9 form a turbine blade stage of the pump unit 20. Each stationary blade 9 is held with the each stationary blade 9 being sandwiched between adjacent ones of spacers 10 in the upper-to-lower direction. The spacers 10 have the function of holding the stationary blades 9, as well as having the function of maintaining a gap between adjacent ones of the stationary blades 9 at a predetermined interval.

A screw stator 11 forming a drag pump stage is provided at a later stage (the lower side as viewed in the figure) of the stationary blades 9, and a gap is formed between an inner peripheral surface of the screw stator 11 and a cylindrical portion 12 of the rotor 2. The rotor 2 and the stationary blades 9 held by the spacers 10 are housed in a pump case 13 provided with a suction port 13*a*. When the shaft 3 attached to the rotor 2 is rotatably driven by a motor 6 while being non-contact supported by the electromagnets 51, 52, gas is exhausted from the suction port 13*a* toward a back pressure side. The gas exhausted to the back pressure side is discharged by an auxiliary pump (not shown) connected to an exhaust port 26.

The power source 30 is, with bolts, fixed to a bottom side of the pump base 4 provided at the pump unit 20. The power source 30 configured to drivably control the pump unit 20 includes electric components forming a main control section, a magnetic bearing drive control section, a motor drive control section, etc. These electric components are housed in a housing of the power source 30. A top panel 302 forming a portion of the power source housing of the power source 30 is provided with an opening 302*a*. A plug 324 of a power source cable 323 provided on a power source side is, through the opening 302*a*, connected to a receptacle 411 provided on a bottom surface of the pump base 4. In this manner, the power source cable 323 is connected to the pump unit 20.

A cooling fan 34 is provided at the side of the pump unit 20. In an example illustrated in FIG. 1, the cooling fan 34 is fixed to a side surface of the top panel 302. As indicated by a dashed line, leftward cooling air formed by the cooling fan 34 as viewed in the figure is blown onto the pump base 4, thereby cooling the pump unit 20.

Figure 2:
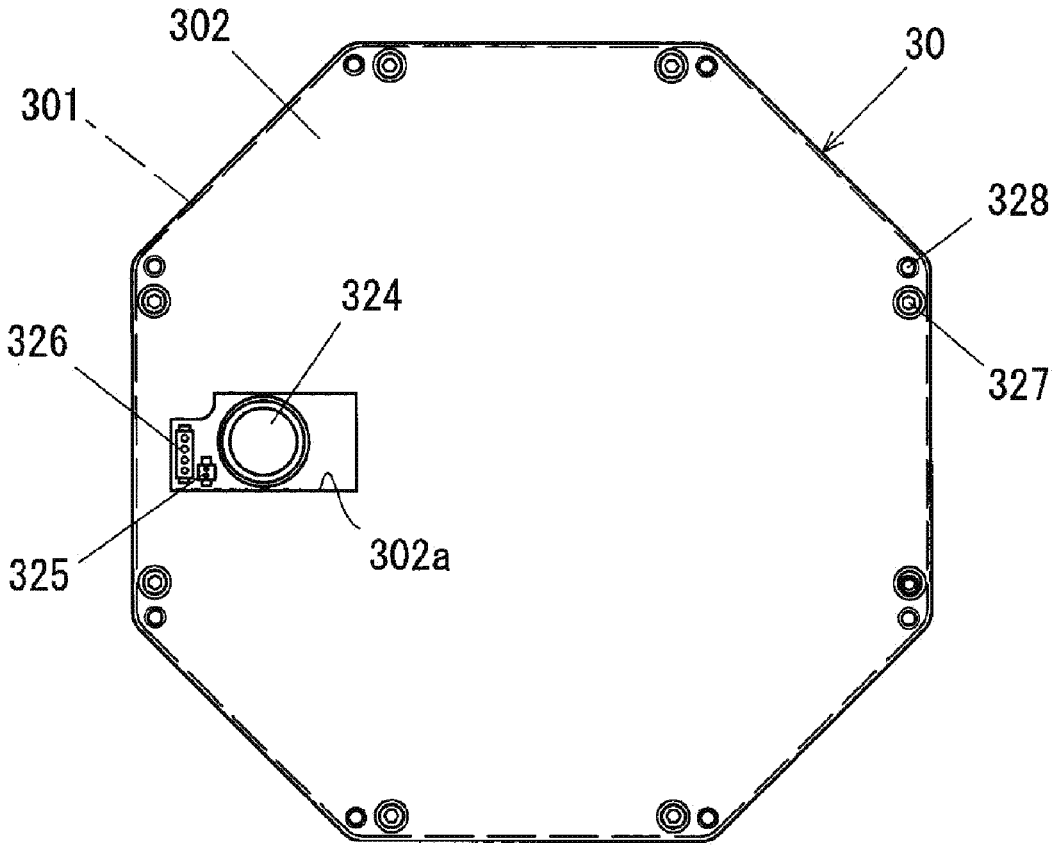
FIG. 2 is a plan view of a power source from a pump unit.

FIG. 2 is a plan view of the power source 30 from the pump unit 20. The shape of the power source 30 as viewed in the plane is a regular octagonal shape, and the regular octagonal top panel 302 is fixed to a power source case 301 with bolts 327. In an example illustrated in FIG. 2, the shape of the opening 302*a* formed at the top panel 302 is a substantially rectangular shape. The top panel 302 is provided with screw holes 328 for fixing the power source 30 to the pump base 4 with the bolts 40 (see FIG. 1).

The plug 324 of the power source cable 323 is drawn from the opening 302*a*, and then, is connected to the receptacle 411 provided on the bottom surface of the pump base 4 (see FIG. 1). Similarly, a temperature sensor cable 325 and a brake heater cable 326 are drawn from the opening 302*a*, and then, are connected to a temperature sensor (not shown) and a brake heater (not shown) provided on a pump unit side. Thus, the opening 302*a* is largely formed to the extent that drawing of each cable is not interfered. In a case where the attachment positions of the receptacle 411, the temperature sensor, and the brake heater at the pump base 4 are significantly different from each other, openings for drawing the power source cable 323, the temperature sensor cable 325, and the brake heater cable 326 need to be formed corresponding to each position.

Figure 3:
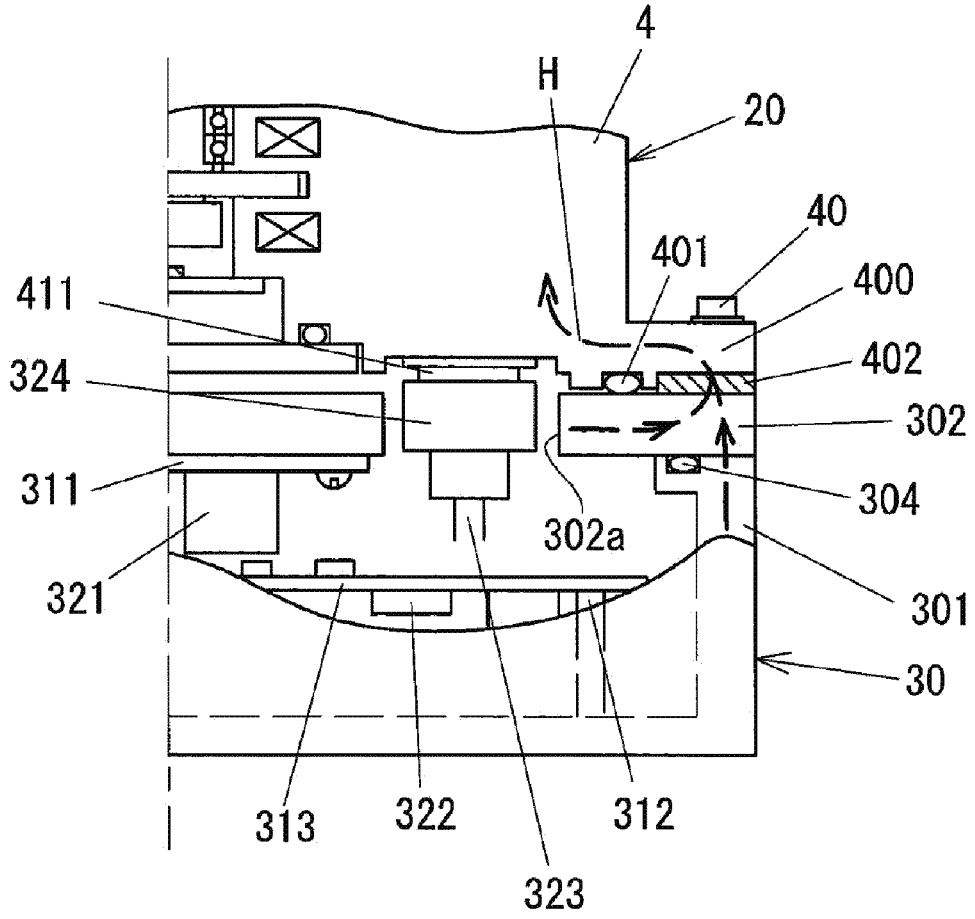
FIG. 3 is a view for describing a structure of a fixing portion between the power source and the pump unit.

FIG. 3 is a view for describing a structure of a fixing portion between the power source 30 and the pump unit 20 of the vacuum pump 1 illustrated in FIG. 1. The power source 30 includes the power source case 301 as the power source housing and the top panel 302. A member (e.g., aluminum alloy) having a relatively-high coefficient of thermal conductivity is used as the materials of the power source case 301 and the top panel 302. The electric components of the power source 30 are housed in this power source housing. In an example illustrated in FIG. 3, an electric component 321 with a relatively-great amount of heat generation is mounted on a circuit board 311 fixed to the top panel 302. On the other hand, an electric component 322 with a relatively-small amount of heat generation is mounted on a circuit board 313 fixed to the power source case 301. The circuit board 313 is fixed to the power source case 301 through a support rod 312.

An O-ring seal 304 as a sealing member is provided between the power source case 301 and the top panel 302, the power source case 301 and the top panel 302 being fixed together. The top panel 302 is, with the bolts 40, fixed to a base flange 400 provided at the pump base 4. A heat transfer member 402 and an O-ring seal 401 as a sealing member are provided between the top panel 302 and the base flange 400. The O-ring seal 401 can prevent external air from entering the power source housing through a fixing portion between the pump base 4 and the top panel 302. As a result, damage of the power source 30 due to moist air entrance into the power source housing from external environment is prevented.

A member (e.g., metal) having a relatively-high coefficient of thermal conductivity is used for the heat transfer member 402. Preferably, a member having a thermal conductivity coefficient equal to or higher than those of members used for the power source housing (the power source case and the top panel 302) and the pump base 4 may be used. For example, aluminum-based or copper-based metal is used. Note that in the example illustrated in FIG. 3, a ring-shaped metal plate is used as the heat transfer member 402, but the heat transfer member 402 is not necessarily in the ring shape. Such a heat transfer member 402 is arranged at the fixing portion in contact with the pump base 4 and the top panel 302, and therefore, heat of the power source 30 can be effectively transferred to the pump base 4.

Heat generated at the electric components is mainly transferred to the top panel 302 and the power source case 301, and then, is transferred to the pump base 4 of the pump unit 20 through the heat transfer member 402 as indicated by a dashed arrow H. Eventually, the heat is released to the air. The circuit board 311 on which the electric component 321 is mounted is fixed to the top panel 302 contacting the heat transfer member 402, and therefore, the efficiency of cooling the electric component mounted on the circuit board 311 can be improved. Thus, an electric component with a great amount of heat generation is preferably arranged on the top panel 302. Note that radiation from the pump base 4 to the air may be natural radiation, but in the example illustrated in FIG. 1, forced air cooling is performed using the cooling air from the cooling fan 34.

(C1) In the above-described embodiment, the vacuum pump 1 is the vacuum pump configured such that the pump unit 20 and the power source 30 are integrated together. The multiple cables 323, 325, 326 interposed between the pump base 4 as a pump housing and the top panel 302 as the power source housing connect the pump unit 20 and the power source 30 together through the opening 302*a* formed at the top panel 302. Further, the heat transfer member 402 is provided in contact with the pump base 4 and the top panel 302 at the fixing portion between the pump base 4 and the top panel 302, and the O-ring seal 401 as the sealing member configured to seal a clearance between the pump base 4 and the top panel 302 is provided at the fixing portion.

Thus, according to the present embodiment, radiation performance of the power source 30 can be ensured while moisture air entrance into the power source 30 from the external environment can be prevented. As a result, damage of the power source 30 due to moisture air entrance can be prevented.

(C2) Further, the cooling fan 34 is provided as illustrated in FIG. 1 to perform forced air cooling of the pump base 4 by means of the cooling air. Thus, the efficiency of cooling the pump unit 20 can be improved. Note that in the configuration illustrated in FIG. 1, the cooling air of the cooling fan 34 is sent to the pump base 4 as the pump housing. However, the cooling fan 34 may be shifted to a base side such that the cooling air is sent to both of the pump base 4 and the power source housing (the power source case 301 and the top panel 302).

The following variations fall within the scope of the present invention, and one or more of the variations may be combined with the above-described embodiment.

(First Variation)

Figure 4:
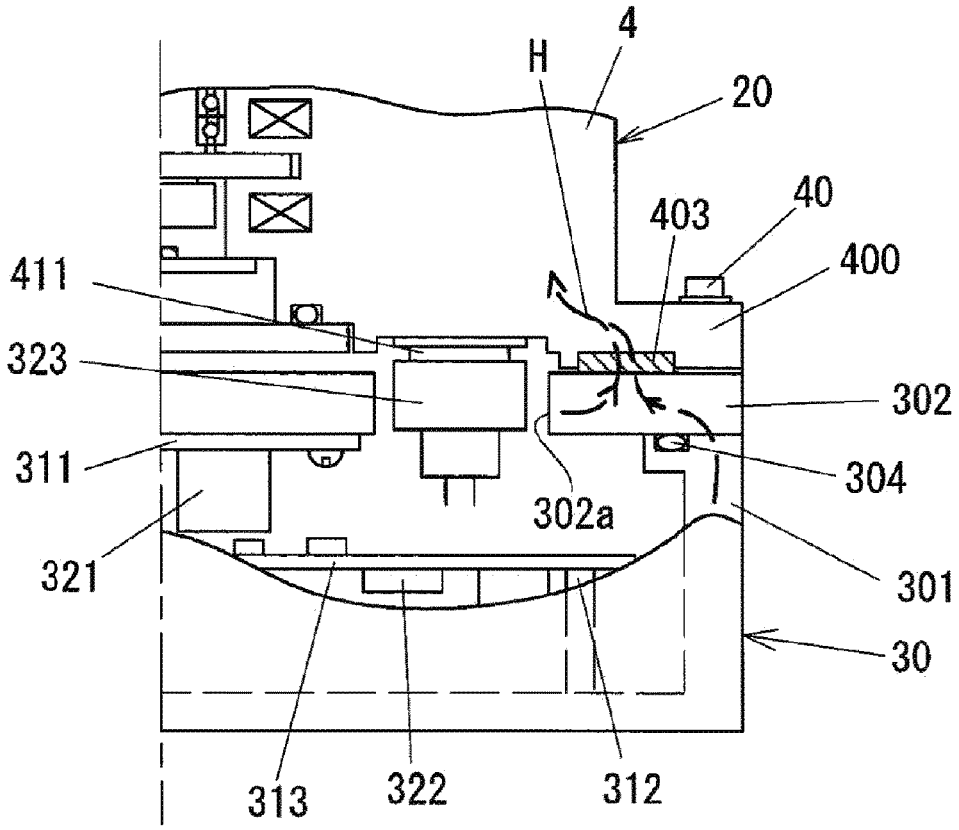
FIG. 4 is a view of a first variation.

FIG. 4 is a view of a first variation of the above-described embodiment. In the embodiment illustrated in FIG. 3, the O-ring seal 401 as the sealing member and the heat transfer member 402 are provided between the pump base 4 and the top panel 302. However, in the first variation, only a heat transfer member 403 exhibiting sealability is arranged. Easily plastic deformable metal foil (e.g., copper foil), thinly-applied thermal grease (e.g., a base material, such as silicone, containing a metal component) on a metal plate, thermal silicone, etc. is used as the heat transfer member 403. For example, in the case of using the copper foil, the coefficient of thermal conductivity of the heat transfer member 403 can be equal to or higher than that of the member used for the pump base 4 or the power source housing.

Even when the heat transfer member 403 also has the function of the sealing member as described above, normal-pressure external air entrance into the normal-pressure power source housing can be sufficiently prevented, and damage of the power source 30 due to moisture air entrance into the power source housing can be prevented.

(Second Variation)

Figure 5:
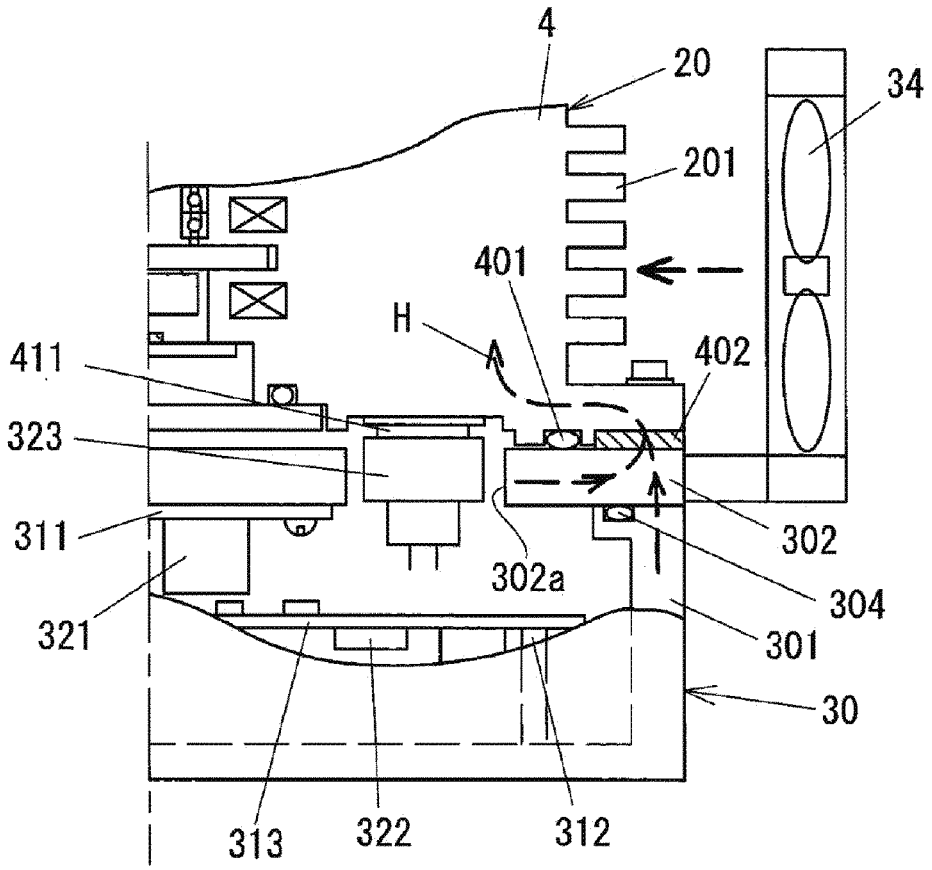
FIG. 5 is a view of a second variation.

FIG. 5 is a view of a second variation of the above-described embodiment. In the second variation, radiation fins 201 are, in addition to the configuration of the above-described embodiment (see, e.g., FIGS. 1 and 3), provided on an outer peripheral surface of the pump base 4. The cooling air is sent from the cooling fan 34 to the radiation fins 201. As a result, radiation performance of the pump base 4 can be further improved, and the temperatures of the pump unit 20 and the power source 30 can be held lower than those of the above-described embodiment.

In FIG. 5, the radiation fins 201 are directly formed on the outer peripheral surface of the pump base 4, but a separate heat sink with radiation fins may be attached to the outer peripheral surface of the pump base 4. Note that the configuration of providing the radiation fins 201 on the outer peripheral surface of the pump base 4 can be also applied to the first variation illustrated in FIG. 4, and similar advantageous effects can be provided.

(Third Variation)

Figure 6:
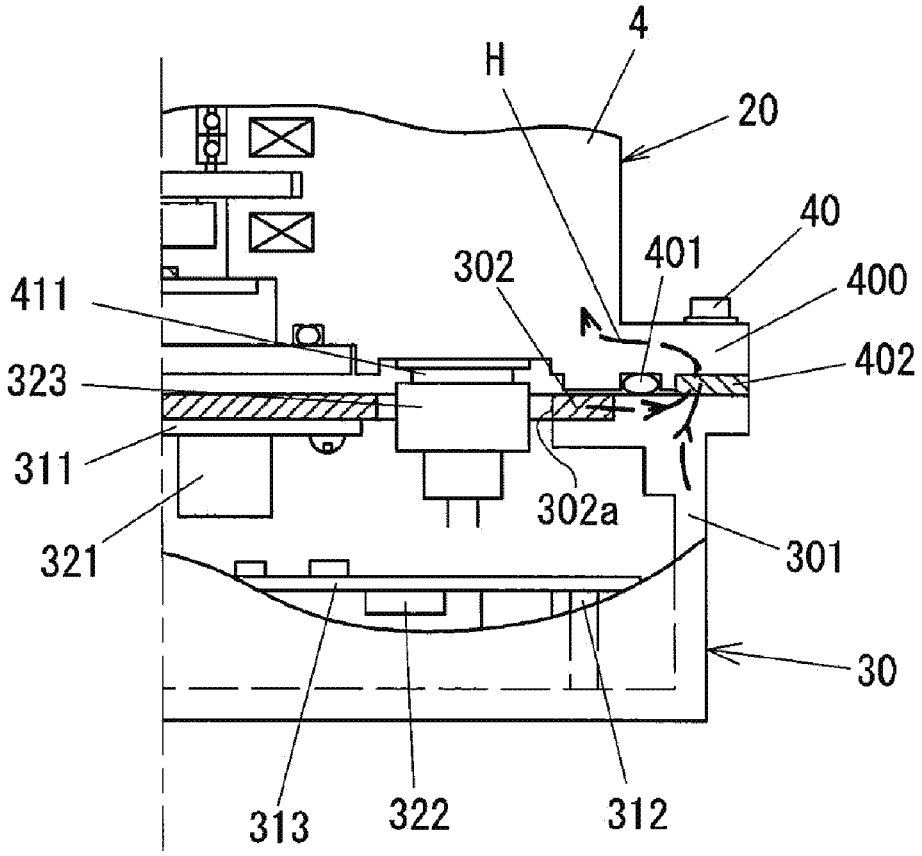
FIG. 6 is a view of a third variation.

FIG. 6 is a view of a third variation of the above-described embodiment. In the third variation, it is configured such that an upper end of the power source case 301 is fixed to the pump base 4 with the bolts 40 and heat of the power source 30 is transferred from the power source case 301 to the pump base 4 of the pump unit 20 through the heat transfer member 402. The top panel 302 provided with the opening 302*a* is attached to the power source case 301. Heat of the top panel 302 is transferred to the pump base 4 through the power source case 301 and the heat transfer member 402.

(Fourth Variation)

Figure 7:
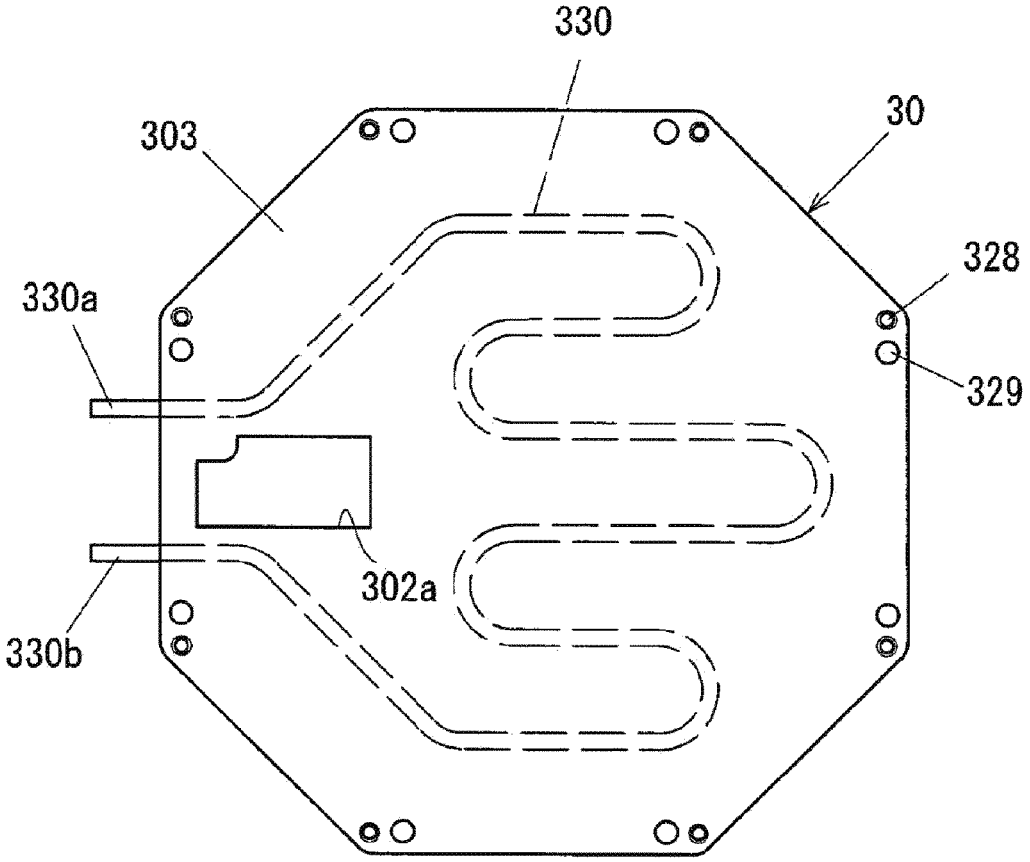
FIG. 7 is a view of a fourth variation.

FIG. 7 is a view of a fourth variation of the above-described embodiment. FIG. 7 is a plan view of a top panel 303. The top panel 303 is used instead of the top panel 302 of FIG. 2. The top panel 303 includes a refrigerant path 330 for circulating liquid refrigerant such as coolant water, and other configurations are similar to those of the top panel 302 illustrated in FIG. 2. Through-holes indicated by a reference numeral "329" are bolt holes into which the bolts 327 of FIG. 2 are inserted. In an example illustrated in FIG. 7, the refrigerant path 330 is formed in such a manner that a metal pipe such as a copper pipe is casted into the top panel 302. An inlet portion 330*a* and an outlet portion 330*b* of the metal pipe protrude from the left side surface of the top panel 303 as viewed in the figure.

Note that in the case of the fourth variation, the top panel 303 is cooled by the liquid refrigerant, and therefore, heat of the pump base 4 is transferred to the top panel 303 through the heat transfer member 402. The heat transferred from the pump base 4 and the power source case 301 to the top panel 303 is released to the liquid refrigerant flowing through the refrigerant path 330.

(Fifth Variation)

Figure 8:
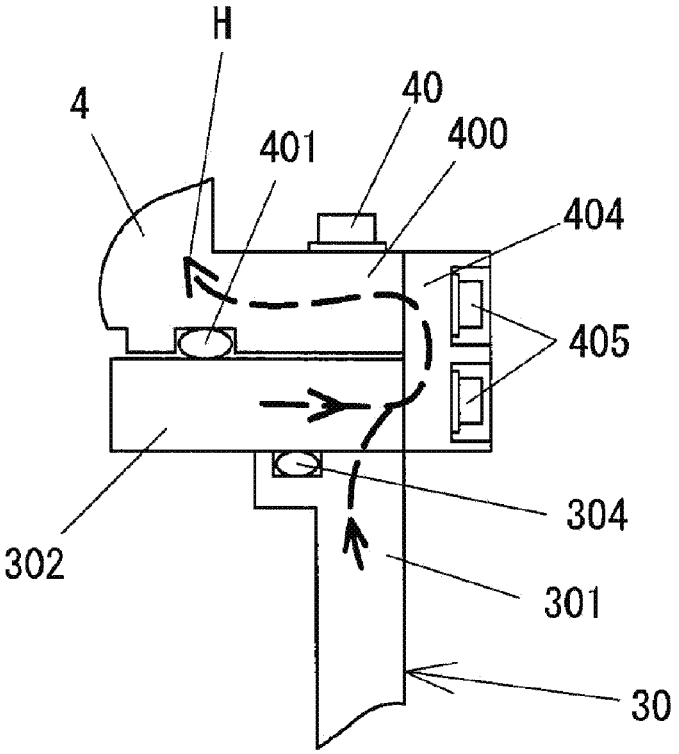
FIG. 8 is a view of a fifth variation.

FIG. 8 is a view of a fifth variation of the above-described embodiment. In the above-described embodiment, the heat transfer member is interposed between the base flange 400 of the pump base 4 and the power source housing (the top panel 302 or the power source case 301). In the fifth variation illustrated in FIG. 8, a heat transfer member 404 is fixed with bolts 405 in contact with side surfaces of the base flange 400 and the top panel 303 as the fixing portion between the pump housing and the power source housing. Since the heat transfer member 404 is provided on the side surfaces of the base flange 400 and the top panel 303 as described above, attachment, detachment, or replacement of the heat transfer member 404 can be facilitated. Moreover, the heat transfer member 404 is provided in an exposed state at the side of the base flange 400 and the top panel 303. Thus, radiation fins may be formed at the heat transfer member 404 itself, thereby actively releasing heat from the heat transfer member 404 to the air.

The embodiment and the variations have been described above, but the present invention is not limited to these contents. Other aspects conceivable within the scope of the technical idea of the present invention are also included in the scope of the present invention. For example, the present invention is also applicable to other power source-integrated vacuum pumps than the turbo-molecular pump.

What is claimed is:

1. A power source-integrated vacuum pump in which a pump main body including a pump rotor and a pump power source configured to supply power to the pump main body are integrated together, comprising:

a pump case configured to house the pump rotor;

a pump base connected to the pump case;

a power source housing of the pump power source and a top panel connected to an upper portion of the power source housing, the top panel being fixed to the pump base;

a heat transfer member provided at a fixing portion between the pump base and the top panel in contact with the pump base and the top panel; and a sealing member provided at the fixing portion between the pump base and the top panel to seal between the pump base and the top panel, wherein the heat transfer member is a ring-shaped metal plate, with one surface of the metal plate contacted with the pump base, and an other surface of the metal plate contacted with the top panel, and the heat transfer member is located radially outward relative to the sealing member and is separate and apart from the sealing member, and has a greater coefficient of thermal conductivity than the sealing member to thereby transfers heat of the power source to the pump base.

2. The power source-integrated vacuum pump according to claim 1, further comprising:

a cooling fan configured to send cooling air to the pump base.

3. The power source-integrated vacuum pump according to claim 2, wherein a heat sink is provided in a region of the pump base to which the cooling air is sent.

4. The power source-integrated vacuum pump according to claim 1, wherein the power source housing has a housing wall portion fixed to at least some of multiple electric components provided at the pump power source and contacting the heat transfer member.

5. The power source-integrated vacuum pump according to claim 4, wherein the housing wall portion includes a refrigerant path for circulating liquid refrigerant.

6. The power source-integrated vacuum pump according to claim 1, wherein a coefficient of thermal conductivity of the heat transfer member is higher than those of the pump base and the power source housing.

* * * * *